US005376466A

United States Patent [19]

Koyama et al.

[11] Patent Number: 5,376,466

[45] Date of Patent: Dec. 27, 1994

[54] CERMET BLADE MEMBER

[75] Inventors: Takashi Koyama; Susumu Uchida; Ken Yanai, all of Omiya, Japan

[73] Assignee: Mitsubishi Materials Corporation, Tokyo, Japan

[21] Appl. No.: 960,693

[22] Filed: Oct. 14, 1992

[30] Foreign Application Priority Data

| | | | |
|---|---|---|---|
| Oct. 17, 1991 | [JP] | Japan | 3-298501 |
| Oct. 29, 1991 | [JP] | Japan | 3-309733 |
| Oct. 29, 1991 | [JP] | Japan | 3-309734 |
| Oct. 29, 1991 | [JP] | Japan | 3-309735 |
| Oct. 29, 1991 | [JP] | Japan | 3-309736 |

[51] Int. Cl.[5] ..... B23B 27/14

[52] U.S. Cl. ..... 428/698; 501/87; 501/88; 501/91; 501/92; 501/93; 501/96; 501/98; 501/103; 428/704

[58] Field of Search ..... 501/87, 88, 91, 92, 501/93, 96, 98, 103; 428/704, 698

[56] References Cited

U.S. PATENT DOCUMENTS

| | | | |
|---|---|---|---|
| 4,279,651 | 7/1981 | Fujimori et al. . | |
| 4,660,114 | 4/1987 | Yamakawa et al. | 360/122 |
| 4,748,138 | 5/1988 | Watanabe et al. | 501/87 |
| 4,770,673 | 9/1988 | Ketcham et al. | 501/103 |

FOREIGN PATENT DOCUMENTS

| | | |
|---|---|---|
| 0252046 | 1/1988 | European Pat. Off. . |
| 0376878 | 7/1990 | European Pat. Off. . |
| 52-94814 | 8/1977 | Japan . |
| 63-134654 | 6/1988 | Japan . |
| 2039876 | 8/1980 | United Kingdom . |
| WO90/07017 | 6/1990 | WIPO . |

OTHER PUBLICATIONS

Chemical Abstract, vol. 11, AN-62369, JP-A-63 303 029, S. Kono, et al., "Sintered Cerment Based on Cubic Boron Nitride".

*Primary Examiner*—A. A. Turner

*Attorney, Agent, or Firm*—Oblon, Spivak, McClelland, Maier & Neustadt

[57] ABSTRACT

A cermet blade member including a cermet substrate is provided which consists essentially of: 0.2% by weight to 8% by weight of a binder phase of at least one binder metal of cobalt and nickel; 5% by weight to 30% by weight of a first hard dispersed phase of at least one material of zirconia and a stabilized zirconia; and the remainder of a second hard dispersed phase of at least one metal carbo-nitride. The metal of the above-mentioned metal carbo-nitride is selected from metals in Group IVA in a periodic table. In addition, a cermet blade member including the cermet substrate and a hard coating layer formed on the surface of the cermet substrate is provided. The hard coating layer consists of at least one layer of a compound selected from a titanium carbide, a titanium nitride, a titanium carbo-nitride, titanium carbo-oxide represented by TiCO, titanium carbo-oxi-nitride represented by TiCNO and an aluminum oxide.

11 Claims, No Drawings

CERMET BLADE MEMBER

BACKGROUND OF THE INVENTION

1. Field of the Invention

The present invention relates to a cermet blade member which exhibits a superior thermoplastic deformation resistance and a high wear resistance under particularly severe conditions associated with high heat-generation. The present invention also pertains to a surface-coated cermet blade member having an excellent bonding strength between a cermet substrate and a hard coating layer.

2. Prior Art

Heretofore, there has been well known a blade member of titanium carbo-nitride (TiCN) based cermet for cutting steels, ductile cast irons and the like, comprising:

10% to 49% by weight of a binder phase including nickel (Ni) as a main ingredient and the remainder of a hard dispersed phase composed of TiCN, as described in Japanese Patent Application First Publication No. 52- 94,814.

The conventional blade member of TiCN based cermet as described above has a relatively high proportion of the binder phase with respect to the hard dispersed phase. For this reason, the conventional blade member is vulnerable to thermoplastic deformation within a relatively short period of time, under particularly severe conditions in heavy duty cutting such as high feed cutting and deep cutting, or high-speed cutting accompanied with high heat generation at the cutting edge, these types of cutting being employed in the recent trend of energy-saving and high speed cutting processes.

In addition, as described in Japanese Patent Application First Publication No. 63-134,654, a surface-coated blade member for cutting steel, ductile cast iron and the like has been proposed which comprises a TiCN based cermet substrate and a hard coating layer deposited on the substrate, the hard coating layer having an average layer thickness of 0.5 μm to 10 μm. The hard coating layer has at least one layer, each layer being made of a titanium carbide, a titanium nitride, or a titanium carbo-nitride. The TiCN based cermet substrate has the following composition:

15% to 20% by weight of a binder phase including nickel (Ni) and cobalt (Co);

20% to 40% by weight of a hard dispersed phase of metal carbide; and the remainder of a hard dispersed phase composed of TiCN and unavoidable impurities.

The conventional surface-coated blade member as described above does not have a sufficient bonding strength between the substrate and the coating layer. For this reason, under particularly severe conditions in heavy duty cutting or high-speed cutting, accompanying the recent trend of energy-saving and high-speed cutting processing, the hard coating layer of the surface-coated blade member is susceptible to separation from the substrate, terminating the tool life of the blade member within a relatively short period of time.

SUMMARY OF THE INVENTION

It is therefore an object of the present invention to provide a cermet blade member which is particularly superior in thermoplastic deformation resistance under severe conditions.

Another object of the present invention is to provide a cermet blade member comprising a cermet substrate and a hard coating layer, which has an increased bonding strength between the substrate and the coating layer.

According to a first aspect of the present invention, there is provided a cermet blade member comprising a cermet substrate consisting essentially of:

0.2% by weight to 8% by weight of a binder phase of at least one binder metal selected from the group consisting of cobalt and nickel;

5% by weight to 30% by weight of a first hard dispersed phase of at least one material selected from the group consisting of zirconia and a stabilized zirconia; and the remainder of a second hard dispersed phase of at least one metal carbo-nitride, the metal of said metal carbo-nitride being selected from metals in Group IVA in a periodic table.

According to a second aspect of the present invention, there is provided a cermet blade member comprising the cermet substrate described above and a hard coating layer formed on the surface of the cermet substrate, the hard coating layer comprising at least one layer of a compound, said compound being selected from the group consisting of a titanium carbide, a titanium nitride, a titanium carbo-nitride, a titanium carbo-oxide (TiCO), a titanium carbo-oxi-nitride (TiCNO) and an aluminum oxide.

The above objects, effects, features, and advantages of the present invention will become more apparent from the following description of preferred examples thereof.

DETAILED DESCRIPTION OF THE INVENTION

The results of extensive study directed towards the improvement of (I) a cermet blade member or (II) a surface-coated cermet blade member, by the inventors have revealed the following:

(I) cermet blade member:

(a) If the conventional TiCN based cermet for the blade member has the binder phase in the amount of not more than 8% by weight, instead of in the amount of 10% to 49% by weight, the thermoplastic deformation resistance of the cermet is improved. However, the TiCN based cermet having not more than 8% by weight of the binder phase cannot secure a desired sintering degree. For this reason, the strength of the cermet is lowered extremely.

(b) In the case where the TiCN based cermet having not more than 8% by weight of the binder phase includes at least one of zirconia (hereinafter referred to as "$ZrO_2$") and stabilized $ZrO_2$ in the amount of 5% to 30% by weight, the cermet exhibits a desired sintering degree and controls the grain growth of TiCN to allow the presence of a microstructure. For this reason, such cermet can secure a sufficient strength and exhibit a superior thermoplastic deformation resistance, so that a cermet blade member composed of such the cermet can exhibit an excellent thermoplastic deformation resistance and a superior wear resistance under particularly severe conditions associated with high heat-generation over a long period of time.

(II) surface-coated cermet blade member:

(a) If the conventional TiCN based cermet for a surface-coated blade member has a binder phase in the amount of not more than 8% by weight, instead of in the amount of 15% to 20% by weight, the bonding strength between the hard coating layer and the substrate is extremely improved. However, the TiCN based cermet having not more than 8% by weight of the binder phase cannot secure a desired sintering degree. For this reason, the strength of the cermet is lowered extremely.

(b) In the case where the TiCN based cermet having not more than 8% by weight of the binder phase includes 5% to 30% by weight of at least one of zirconia (hereinafter referred to as "$ZrO_2$") and stabilized $ZrO_2$, instead of the metal carbide as described in Japanese Patent Application First Publication No. 63-134654, the cermet exhibits a desired sintering degree even if the amount of the binder phase is decreased. Furthermore, the bonding strength between the cermet substrate and the hard coating layer is extremely improved due to reduction in the amount of the binder phase. Therefore, the surface-coated cermet blade member can display superior cutting performance for a long period of time without separating the hard coating layer from the substrate under severe conditions.

Some explanations for the components of the cermet blade member substrates according to the present invention are given hereafter.

(a) Co and/or Ni: 0.2% to 8% by weight

The Co and/or Ni have an action that increases the sintering degree and the strength of the cermet. If the content of the Co and/or Ni is less than 0.2% by weight, the Co and/or Ni cannot secure a desired sintering degree and a sufficient strength. On the other hand, if the content exceeds 8% by weight, the thermoplastic deformation resistance of the cermet is degraded. In the surface-coated cermet blade member comprising the cermet substrate and the hard coating layer, if the content of the Co and/or Ni exceeds 8% by weight, the bonding strength between the hard coating layer and the cermet substrate is extremely lowered.

Therefore, the content of the Co and Ni is set in the range of 0.2% by weight and 8% by weight, more preferably in the range of 0.5% by weight and 5% by weight, and most preferably in the range of 1% by weight and 3% by weight.

(b) $ZrO_2$ and stabilized $ZrO_2$: 5% to 30% by weight.

The "$ZrO_2$" used herein means a pure $ZrO_2$. The "stabilized $ZrO_2$" is a solid solution consisting of 88 mol % to 99 mol % of $ZrO_2$ and 1 mol % to 12 mol % of at least one of oxides made from yttrium (Y), calcium (Ca), magnesium (Mg) or rare earth elements. The $ZrO_2$ and stabilized $ZrO_2$ act to profoundly increase the sintering degree and the strength of the cermet and can control the grain growth of TiCN so as to achieve a microstructure, even if the content of the binder phase is not more than 8% by weight. Furthermore, the cermet blade member is improved in thermoplastic deformation resistance due to the reduction in the content of the binder phase. In addition, using such a cermet substrate for the blade member, a surface-coated blade member having an excellent bonding strength between the substrate and the coating layer can be produced. However, with less than 5% by weight of $ZrO_2$ and stabilized $ZrO_2$, such desired properties cannot be obtained, and with more than 30% by weight of $ZrO_2$ and stabilized $ZrO_2$, wear resistance of the cermet is degraded.

Therefore, the content of the $ZrO_2$ and stabilized $ZrO_2$ is set in the range of 5% by weight and 30% by weight, and more preferably in the range of 10% by weight to 25% by. weight.

(c) Boride: 0.1% to 20% by weight

In the case where the hard dispersed phase of the cermet substrate for the blade member includes 0.1% by weight to 20% by weight of at least one of titanium boride and zirconium boride, the thermal conductivity of the cermet substrate is improved. For this reason, the borides contribute to an improvement in the thermoplastic deformation resistance of the cermet blade member. With more than 20% by weight of the borides, the sintering degree is lowered.

Therefore, the content of the borides is set in the range of from 0.1% by weight to 20% by weight.

(d) Chromium, chromium carbide and chromium nitride: 0.1% to 5% by weight.

In the case where the hard dispersed phase of the cermet substrate for the blade member includes 0.1% by weight to 5% by weight of at least one material selected from the group consisting of chromium, chromium carbide and chromium nitride, the thermal conductivity of the cermet substrate is improved. For this reason, the chromium, chromium carbide and/or chromium nitride contribute to an improvement in the thermoplastic deformation resistance of the cermet blade member. With more than 5% by weight of the the chromium, chromium carbide and chromium nitride, the strength is lowered.

Therefore, the content of the chromium, chromium carbide and chromium nitride is set in the range of from 0.1% by weight to 5% by weight.

(e) Oxygen atoms and boron atoms (with which the nitrogen and carbon of the carbo-nitride may be replaced).

In general, a carbide, nitride, of oxide of a metal in Group IVA in a periodic table has a NaCl-type of crystal structure. A solid solution of the same is a homogeneous solid solution. In the present invention, the nitrogen and carbon of the carbo-nitride employed as a main ingredient may be replaced with oxygen or boron in the amount of not more than 15 atomic percent. It is assumed that the oxygen or boron is mainly provided from the $ZrO_2$ or boride and dispersed during the sintering process. In particular, the oxygen is also provided from a fine powders of the starting materials because the oxygen is adsorbed on the surface of the fine powder. For this reason, the nitrogen and carbon of the carbo-nitride tend to replace with the oxygen.

(f) Unavoidable impurities

The impurities included in the starting material may be in the amount of not more than 1% by weight per each impurity component. Such unavoidable impurities include: molybdenum (Mo); tungsten (W); tantalum (Ta); niobium (Nb); iron (Fe); a carbide of said metal; a nitride of said metal; an oxide of said metal; a boride of said metal; and a solid solution thereof.

In the cermet blade member having the cermet substrate consisting essentially of at least one of TiCN and ZrCN according to the present invention, the atomic ratio of carbon atoms to nitrogen atoms (C:N) of TiCN and/or ZrCN is preferably in the range of 1:9 to 9:1. If the C:N ratio is less than 1:9, the wear resistance is degraded because of inadequate hardness. On the other hand, with a ratio of more than 9:1 of C:N, the grain growth of TiCN and/or ZrCN can occur easily, causing a degradation in strength.

With regard to the surface-coated cermet blade member according to the present invention, it is preferable that the hard coating layer should have an average thickness in the range of 0.5 μm to 20 μm. With an average thickness of less than 0.5 μm for the hard coating layer, the desired wear resistance cannot be obtained, and with an average thickness of more than 20 μm for the hard coating layer, chipping is liable to occur.

The invention will now be described with reference to the preferred Examples of the cermet blade members according to the present invention. The preferred Examples are given simply by way of illustration and cannot in any way limit the scope of the invention.

In the Examples, the percentages are given by weight unless otherwise indicated.

EXAMPLES (I) Cutting inserts of cermet blade members

Example 1

There were prepared, as starting material powders, TiCxNy powder, ZrCxNy powder, $ZrO_2$ powder, stabilized $ZrO_2$ powder in which 3 mol % of $Y_2O_3$ was added to $ZrO_2$ to form a solid solution therewith (hereafter, referred to as "$ZrO_2(Y_2O_3)$"), stabilized $ZrO_2$ powder in which 4 mol % of CaO was added to $ZrO_2$ to form a solid solution therewith (hereafter, referred to as "$ZrO_2$ (CaO)") , stabilized $ZrO_2$ powder in which 9 mol % of MgO was added to $ZrO_2$ to form a solid solution therewith (hereafter, referred to as "$ZrO_2$ (MgO)"), stabilized $ZrO_2$ powder in which 8 mol % of $CeO_2$ was added to $ZrO_2$ to form a solid solution therewith (hereafter, referred to as "$ZrO_2$ ($CeO_2$) "), stabilized $ZrO_2$ powder in which 2 mol % of $La_2O_3$ was added to $ZrO_2$ to form a solid solution therewith (hereafter, referred to as "$ZrO_2$ ($La_2O_3$)"), Co powder, Ni powder, Mo powder, and C (carbon) powder, each of which had an average particle size of from 0.5 μm to 1.5 μm. These powders were blended into the compositions set forth in Table 1. The blended powders were subjected to wet-mixing in a ball mill for 72 hours and dried. Then, the mixed powders were pressed into green compacts under a pressure of 1 ton/cm$^2$. The green compacts thus obtained were sintered for a retaining time of 3 hours under an inert gas atmosphere at a predetermined temperature ranging between 1400° C. and 1700° C., and subsequently subjected to a hot isostatic pressing (HIP) treatment under a pressure of 1500 atm at a predetermined temperature ranging between 1300° C. and 1600° C. to form cutting inserts of a cermet blade member according to the present invention (hereafter, referred to as "blade members Nos. 1 to 15 of the present invention"), shaped in conformity with SNGN120408 of the ISO Standards.

In addition, for comparison purposes, comparative blade members Nos. 1 to 6, which had compositions other than that claimed in the present invention, and conventional cutting inserts of TiCN based cermet blade members (hereafter, referred to as "conventional blade members Nos. 1 to 3") were prepared by repeating the same procedures as described above.

After microanalysis of blade member No. 13 of the present invention using a field ion microscope, it was found that the carbon and nitrogen in the carbo-nitride had been replaced with oxygen in the amount of about 10 atomic percent.

TABLE 1

| Blade members of the present invention | Composition of compound (% by weight) | | | | | | Flank wear (mm) | Transverse rupture strength (kg/mm$^2$) |
|---|---|---|---|---|---|---|---|---|
| | Co | Ni | ZrO2 | Stabilized ZrO2 | ZrCxNy | TiCxNy | | |
| 1 | 1.5 | 1.0 | 0 | $ZrO_2(Y_2O_3)$:6 | — | TiC0.7N0.3:remainder of weight | 0.15 | 132 |
| 2 | 1.5 | 1.0 | 6 | $ZrO_2(Y_2O_3)$:6 | — | TiC0.7N0.3:remainder of weight | 0.12 | 143 |
| 3 | 1.5 | 1.0 | 12 | $ZrO_2(Y_2O_3)$:6 | — | TiC0.7N0.3:remainder of weight | 0.11 | 157 |
| 4 | 1.5 | 1.0 | 18 | $ZrO_2(Y_2O_3)$:6 | — | TiC0.7N0.3:remainder of weight | 0.14 | 151 |
| 5 | 1.5 | 1.0 | 24 | $ZrO_2(Y_2O_3)$:6 | — | TiC0.7N0.3:remainder of weight | 0.16 | 140 |
| 6 | — | 0.3 | 12 | $ZrO_2$(CaO):6 | ZrC0.5N0.5:41 | TiC0.5N0.5:remainder of weight | 0.14 | 126 |
| 7 | 0.3 | 0.5 | 12 | $ZrO_2(Y_2O_3)$:6 | ZrC0.5N0.5:40 | TiC0.5N0.5:remainder of weight | 0.13 | 137 |
| 8 | 1.0 | 1.5 | 12 | $ZrO_2(Y_2O_3)$:6 | ZrC0.5N0.5:40 | TiC0.5N0.5:remainder of weight | 0.10 | 165 |
| 9 | 4.0 | — | 12 | $ZrO_2(Y_2O_3)$:6 | ZrC0.5N0.5:39 | TiC0.5N0.5:remainder of weight | 0.11 | 161 |
| 10 | 3.0 | 4.0 | 12 | $ZrO_2(CeO_2)$:6 | ZrC0.5N0.5:37 | TiC0.5N0.5:remainder of weight | 0.17 | 148 |
| 11 | 1.2 | 1.8 | 8 | — | ZrC0.3N0.7:remainder of weight | — | 0.11 | 129 |
| 12 | 1.2 | 1.8 | 16 | $ZrO_2$(MgO):7 | ZrC0.3N0.7:remainder of weight | — | 0.12 | 163 |
| 13 | 1.2 | 1.8 | — | $ZrO_2(La_2O_3)$:29 | ZrC0.3N0.7:remainder of weight | — | 0.16 | 139 |
| 14 | 1.8 | 1.2 | 12 | $ZrO_2(Y_2O_3)$:6 | — | TiC0.1N0.9:remainder of weight | 0.19 | 124 |
| 15 | 1.8 | 1.2 | 12 | $ZrO_2(Y_2O_3)$:6 | ZrC0.7N0.3:60 | TiC0.9N0.1:remainder of weight | 0.14 | 130 |

TABLE 2

| | Composition of compound (% by weight) | | | | | | | Flank wear (mm) | Transverse rupture strength (kg/mm$^2$) |
|---|---|---|---|---|---|---|---|---|---|
| | Co | Ni | ZrO2 | Stabilized ZrO2 | ZrCxNy | TiCxNy | Others | | |
| Comparative blade members | | | | | | | | | |
| 1 | 0.1 | — | 12 | $ZrO_2(Y_2O_3)$:6 | — | TiC0.5N0.5:remainder of weight | — | Fractured in 10 min. | 84 |
| 2 | 4.0 | 6.0 | 12 | $ZrO_2(Y_2O_3)$:6 | ZrC0.5N0.5:40 | TiC0.5N0.5:remainder of weight | — | 0.34 | 109 |
| 3 | 1.0 | 1.5 | 3 | — | ZrC0.5N0.5:remainder | — | — | Fractured | 91 |

TABLE 2-continued

| | Composition of compound (% by weight) | | | | | | | Flank wear (mm) | Transverse rupture strength ($kg/mm^2$) |
|---|---|---|---|---|---|---|---|---|---|
| | Co | Ni | ZrO2 | Stabilized ZrO2 | ZrCxNy | TiCxNy | Others | | |
| | | | | | of weight | | | in 15 min. | |
| 4 | 1.0 | 1.5 | 20 | $ZrO_2(CeO_2)$:20 | ZrC0.5N0.5:remainder of weight | — | — | 0.28 | 118 |
| 5 | 1.0 | 1.5 | 12 | $ZrO_2(Y_2O_3)$:6 | — | TiC0.95N0.05:remainder of weight | — | Fractured in 13 min. | 88 |
| 6 | 1.0 | 1.5 | 12 | $ZrO_2(Y_2O_3)$:6 | ZrC0.05N0.95:40 | TiC0.05N0.95:remainder of weight | — | 0.30 | 114 |
| Conventional blade members | | | | | | | | | |
| 1 | — | 10 | — | — | — | TiC0.5N0.5:remainder of weight | Mo:5, C:0.1 | Fractured in 5 min. | 127 |
| 2 | — | 40 | — | — | — | TiC0.2N0.8:remainder of weight | Mo:5, C:0.3 | Fractured in 5 min. | 143 |
| 3 | — | 20 | — | — | — | TiC0.8N0.2:remainder of weight | Mo:10, C:0.5 | Fractured in 5 min. | 131 |

Subsequently, each of the blade members of the present invention, the comparative blade members, and the conventional blade members were subjected to a wet-type continuous high-speed cutting test, and flank wear (cutting edge flank wear) was observed. The conditions of this test were as follows:

Workpiece: round bar (JIS. SCM440; Hardness: $H_RB$ 310)

Cutting speed: 340 m/minute

Feed rate: 0.30 mm/revolution

Depth of cut: 1.5 mm

Cutting time: 20 minutes

In order to evaluate the strength of each blade member thus obtained, resistance (transverse rupture strength) was tested. The results are indicated in Tables 1 and 2.

From the results shown in Tables 1 and 2, each of blade members Nos. 1 to 15 of the present invention could secure an excellent sintering degree due to the action of $ZrO_2$ and stabilized $ZrO_2$ in spite of the fact that the cermet substrate included a relatively small amount of the binder phase. For this reason, each of blade members Nos. 1 to 15 of the present invention had a strength equivalent to that of the conventional blade members No. 1 to 3, which had a relatively large amount of the binder phase. Furthermore, blade members Nos. 1 to 15 of the present invention also had an excellent thermoplastic deformation resistance by virtue of the action of $ZrO_2$ and stabilized $ZrO_2$, and exhibited a superior wear resistance during high-speed cutting associated with high heat generation. In contrast to the blade members of the present invention, the comparative blade members Nos. 1 to 6 showed extremely increased wear amounts or thermoplastic deformation during the cutting process and became fractured. This was due to the fact that the substrate of the comparative blade members included the binder phase or $ZrO_2$ and stabilized $ZrO_2$ in an amount other than that of the claimed range, or because the ratio of carbon atoms to nitrogen atoms in the carbo-nitride was large or small. In addition, as will be apparent from the results shown in Table 1 and 2, the conventional blade members No. 1 to 3 caused thermoplastic deformation due to the high content of the binder phase in the cermet substrate as soon as the cutting process began, and became fractured.

Example 2

There were prepared, as starting material powders, TiCxNy powder, ZrCxNy powder, $ZrO_2$ powder, stabilized $ZrO_2$ powder in which 3 mol % of $Y_2O_3$ was added to $ZrO_2$ to form a solid solution therewith (hereafter, referred to as "$ZrO_2(Y_2O_3)$"), $TiB_2$ powder, $ZrB_2$ powder, Cr powder, $Cr_3C_2$ powder, CrN powder, Co powder, Ni powder, Mo powder, and C (carbon) powder, each of which had an average particle size of 0.5 μm to 1.5 μm. These powders were blended into the compositions set forth in Table 3. The blended powders were subjected to wet-mixing in a ball mill for 72 hours and dried. Then, the mixed powders were pressed into green compacts under a pressure of 1 ton/$cm^2$. The green compacts thus obtained were sintered for a retaining time of 3 hours under an inert gas atmosphere at a predetermined temperature ranging between 1400° C. and 1700° C., and subsequently subjected to a hot isostatic pressing (HIP) treatment under a pressure of 1500 atm at a predetermined temperature ranging between 1300° C. and 1600° C. to form cutting inserts of a cermet blade member according to the present invention (hereafter, referred to as "blade members of the present invention Nos. 16 to 24"), shaped in conformity with SNGN120408 of the ISO Standards.

In addition, for comparison purposes, comparative blade members Nos. 7 to 8, which had compositions other than that claimed in the present invention, and conventional cutting inserts of TiCN based cermet blade members (hereafter, referred to as "conventional blade members Nos. 1 to 3") were prepared by repeating the same procedures as described above.

Following microanalysis of blade member No. 19 of the present invention, it was found that the carbon and nitrogen in the carbo-nitride had been-replaced with oxygen in the amount of about 4 atomic percent and boron in the amount of about 8 atomic percent in blade member No. 19 of the present invention.

TABLE 3

| | Composition of compound (% by weight) | | | | | | | | | | | | | |
|---|---|---|---|---|---|---|---|---|---|---|---|---|---|---|
| | Co | Ni | ZrO2 | Y2O3 stabilized ZrO2 | TiB2 | ZrB2 | Cr | Cr3C2 | CrN | ZrCxNy | TiCxNy | Others | Flank wear (mm) | Transverse rupture strength (kg/mm$^2$) |
| Blade members of the present invention | | | | | | | | | | | | | | |
| 16 | 1.0 | 1.5 | 12 | 6 | 8 | 4 | 0.5 | 1 | 0.5 | — | TiC0.5N0.5: remainder of weight | — | 0.11 | 159 |
| 17 | 1.0 | 1.5 | 12 | 6 | 3 | — | — | — | — | — | TiC0.5N0.5: remainder of weight | — | 0.17 | 141 |
| 18 | 1.0 | 1.5 | 12 | 6 | 8 | 4 | — | — | — | — | TiC0.3N0.7: remainder of weight | — | 0.14 | 150 |
| 19 | 1.0 | 1.5 | 12 | 6 | — | 19 | — | — | — | — | TiC0.3N0.7: remainder of weight | — | 0.18 | 143 |
| 20 | 1.0 | 1.5 | 12 | 6 | — | — | — | 0.2 | — | ZrC0.5N0.5: remainder of weight | — | — | 0.15 | 157 |
| 21 | 1.0 | 1.5 | 12 | 6 | — | — | 0.5 | 1 | 0.5 | ZrC0.7N0.3: remainder of weight | — | — | 0.14 | 144 |
| 22 | 1.0 | 1.5 | 12 | 6 | — | — | 1 | — | 3.5 | ZrC0.7N0.3: remainder of weight | — | — | 0.18 | 130 |
| 23 | 1.0 | 1.5 | 12 | 6 | 8 | 4 | — | — | 0.3 | ZrC0.5N0.5: 34 | TiC0.5N0.5: remainder of weight | — | 0.12 | 157 |
| 24 | 1.0 | 1.5 | 12 | 6 | 8 | 4 | 0.5 | 3 | — | ZrC0.5N0.5: 32 | TiC0.5N0.5: remainder of weight | — | 0.13 | 156 |
| Comparative blade members | | | | | | | | | | | | | | |
| 7 | 1.0 | 1.5 | 12 | 6 | 10 | 15 | — | — | — | ZrC0.5N0.5: 27 | TiC0.5N0.5: remainder of weight | — | Fractured in 15 min. | 97 |
| 8 | 1.0 | 1.5 | 12 | 6 | — | — | — | 3 | 3 | ZrC0.5N0.5: 37 | TiC0.5N0.5: remainder of weight | — | 0.38 | 92 |
| Conventional blade members | | | | | | | | | | | | | | |
| 1 | — | 10 | — | — | — | — | — | — | — | | TiC0.5N0.5: remainder of weight | Mo:5, C:0.1 | Fractured in 4 min. | 127 |
| 2 | — | 40 | — | — | — | — | — | — | — | | TiC0.5N0.5: remainder of weight | Mo:5, C:0.3 | Fractured in 4 min. | 155 |
| 3 | — | 20 | — | — | — | — | — | — | — | | TiC0.5N0.5: remainder of weight | Mo:10, C:0.5 | Fractured in 4 min. | 139 |

Subsequently, each of blade members of the present invention, the comparative blade members, and the conventional blade members was subjected to a wet-type continuous high-speed cutting test, and flank wear (cutting edge flank wear) was observed. The conditions of this test were as follows:

Workpiece: round bar (JIS. SCM440; Hardness: $H_RB$ 300)

Cutting speed: 360 m/minute

Feed rate: 0.25 mm/revolution

Depth of cut: 1.5 mm

Cutting time: 20 minutes

In order to evaluate the strength of each cutting insert thus obtained, resistance (transverse rupture strength) was tested. The results are indicated in Table 3.

From the results shown in Table 3, each of blade members Nos. 16 to 24 of the present invention could secure a superior sintering degree due to the above-described actions of the materials such as $ZrO_2$, stabilized $ZrO_2$, chromium, chromium carbide, and chromium nitride, in spite of the fact that the cermet substrate included a relatively small amount of the binder phase. For this reason, blade members Nos. 16 to 24 of the present invention had a strength equivalent to that of the conventional blade members No. 1 to 3, which had a relatively large amount of the binder phase. Furthermore, blade members of the present invention Nos. 16 to 24 also had a superior thermoplastic deformation resistance by virtue of the above-described actions of materials such as $ZrO_2$ and stabilized $ZrO_2$, and the thermal conductive actions derived from the titanium boride, zirconium boride, chromium, chromium carbide, and chromium nitride, whereby exhibiting a superior wear resistance during high-speed cutting associated with high heat generation. In contrast to the blade members of the present invention, as will be apparent from the results shown in Table 3, the conventional blade members No. 1 to 3 caused thermoplastic deformation due to the high content of the binder phase in the cermet substrate as soon as the cutting process began, and became fractured.

As shown above, since the cermet blade member of the present invention had an excellent thermoplastic deformation resistance, the cermet blade member according to the present invention exhibited excellent wear resistance under severe conditions in heavy duty cutting or high-speed cutting accompanied with high heat generation, thereby exhibiting superior cutting performance over an extended period of time.

(II) Surface-coated cermet blade member

Example 3

There were prepared, as starting material powders, TiCxNy powder, ZrCxNy powder, $ZrO_2$ powder, stabilized $ZrO_2$ powder in which 3 mol % of $Y_2O_3$ was added to $ZrO_2$ to form a solid solution therewith (hereafter, referred to as "$ZrO_2(Y_2O_3)$"), stabilized $ZrO_2$ powder in which 4 mol % of CaO was added to $ZrO_2$ to form a solid solution therewith (hereafter, referred to as "$ZrO_2$(CaO)"), stabilized $ZrO_2$ powder in which 9 mol % of MgO was added to $ZrO_2$ to form a solid solution therewith (hereafter, referred to as "$ZrO_2$(MgO)"), stabilized $ZrO_2$ powder in which 8 mol % of $CeO_2$ was added to $ZrO_2$ to form a solid solution therewith (hereafter, referred to as "$ZrO_2(CeO_2)$"), stabilized $ZrO_2$ powder in which 2 mol % of $La_2O_3$ was added to $ZrO_2$ to form a solid solution therewith (hereafter, referred to as "$ZrO_2(La_2O_3)$"), $TiB_2$ powder, $ZrB_2$ powder, Cr powder, $Cr_3C_2$ powder, CrN powder, Co powder, Ni powder, TaC powder, WC powder, $Mo_2C$ powder, and NbC powder, each of which had an average particle size of 0.5 μm to 1.5 μm. These powders were blended into the compositions set forth in Table 5. The blended powders were subjected to wet-mixing in a ball mill for 72 hours and dried. Then, the mixed powders were pressed into green compacts under a pressure of 1 ton/cm$^2$. The green compacts thus obtained were sintered for a retaining time of 3 hours under an inert gas atmosphere at a predetermined temperature ranging between 1400° C. and 1700° C., and subsequently subjected to a hot isostatic pressing (HIP) treatment under a pressure of 1500 atm at a predetermined temperature ranging between 1300° C. and 1600° C. to form cutting insert substrates for cermet blade members, shaped in conformity with SNGN120408 of the ISO Standards. Next, hard coating layers having compositions and average thicknesses as set forth in Table 5 were formed on the substrates using a chemical vapor deposition device to produce surface-coated blade members Nos. 25 to 32 of the present invention.

For comparison purposes, conventional surface-coated blade members Nos. 4 to 6 were prepared by repeating the same procedures as described above. The substrates of the conventional surface-coated blade members Nos. 4 to 6 were composed of TiCN based cermet including metal carbides and had relatively large amounts of the binder phases.

TABLE 4

| | Composition of compound (% by weight) | | | | | | | | | | | | | | |
|---|---|---|---|---|---|---|---|---|---|---|---|---|---|---|---|
| | Co | Ni | ZrO2 | Stabilized ZrO2 | TiB2 | ZrB2 | Cr | Cr3C2 | CrN | TaC | WC | Mo2C | NbC | ZrCxNy | TiCxNy |
| Surface coated blade members of the present invention | | | | | | | | | | | | | | | |
| 25 | 1.0 | 1.5 | 12 | $ZrO_2(Y_2O_3)$: 6 | — | — | — | — | — | — | — | — | — | — | TiC0.5N0.5: remainder of weight |
| 26 | 3.0 | 1.0 | 10 | $ZrO_2$(CaO): 8 | — | — | — | — | — | — | — | — | — | ZrC0.5N0.5: 39 | TiC0.5N0.5: remainder of weight |
| 27 | 1.2 | 0.8 | 16 | $ZrO_2(La_2O_3)$: 7 | — | — | — | — | — | — | — | — | — | ZrC0.3N0.7: remainder of weight | — |
| 28 | 1.4 | 1.5 | 5 | $ZrO_2(Y_2O_3)$: 13 | 5 | 8 | — | — | — | — | — | — | — | — | TiC0.3N0.7: remainder of weight |
| 29 | 1.0 | 0.8 | 13 | $ZrO_2(CeO_2)$: 6 | — | — | — | 1.5 | 1 | — | — | — | — | — | TiC0.5N0.5: remainder of weight |
| 30 | 1.0 | 1.5 | 8 | $ZrO_2(Y_2O_3)$: 9 | 8 | 4 | 0.5 | 1 | 0.5 | — | — | — | — | ZrC0.5N0.5: 33 | TiC0.5N0.5: remainder of weight |
| 31 | 3.5 | 0.5 | — | $ZrO_2$(MgO): 16 | 6 | 8 | 0.8 | 1.3 | — | — | — | — | — | ZrC0.7N0.3: remainder of weight | — |
| 32 | 0.7 | 2.1 | 13 | $ZrO_2$(CaO): 13 | 6 | 7 | 1.2 | — | 1.1 | — | — | — | — | ZrC0.7N0.3: remainder of weight | — |
| Conventional | | | | | | | | | | | | | | | |

TABLE 4-continued

| | Composition of compound (% by weight) | | | | | | | | | | | | | | |
|---|---|---|---|---|---|---|---|---|---|---|---|---|---|---|---|
| | Co | Ni | ZrO2 | Stabilized ZrO2 | TiB2 | ZrB2 | Cr | Cr3C2 | CrN | TaC | WC | Mo2C | NbC | ZrCxNy | TiCxNy |
| suface coated blade members | | | | | | | | | | | | | | | |
| 4 | 9 | 8 | — | | — | — | — | — | — | — | 10 | — | 10 | | TiC0.5N0.5: remainder of weight |
| 5 | 11 | 5 | — | | — | — | — | — | — | 8 | — | 10 | — | | TiC0.2N0.8: remainder of weight |
| 6 | 13 | 3 | — | | — | — | — | — | — | 10 | 8 | 7 | — | | TiC0.8N0.2: remainder of weight |

TABLE 5

| | Hard coating layer | | | | | | | | | |
|---|---|---|---|---|---|---|---|---|---|---|
| | First layer | | Second layer | | Third layer | | Fourth layer | | | |
| | Composition | Average thickness of layer (μm) | Composition | Average thickness of layer (μm) | Composition | Average thickness of layer (μm) | Composition | Average thickness of layer (μm) | Flank wear (mm) | Transverse rupture strength (kg/mm²) |
| Surface coated blade members of the present invention | | | | | | | | | | |
| 25 | TiC | 2 | — | — | — | | — | — | 0.10 | 141 |
| 26 | TiN | 0.5 | — | — | — | | — | — | 0.16 | 146 |
| 27 | TiCN | 5 | — | — | — | | — | — | 0.14 | 150 |
| 28 | TiCN | 3 | Al2O3 | 3 | — | | — | — | 0.11 | 130 |
| 29 | TiN | 5 | TiC | 5 | — | | — | — | 0.12 | 128 |
| 30 | TiCNO | 3 | TiC | 4 | Al2O3 | 2 | — | — | 0.10 | 137 |
| 31 | TiCN | 1 | Al2O3 | 2 | TiN | 1 | — | — | 0.15 | 144 |
| 32 | TiCN | 3 | TiC | 5 | Al2O3 | 5 | TiN | 3 | 0.17 | 139 |
| Conventional surface coated blade members | | | | | | | | | | |
| 4 | TiCN | 2 | — | — | — | — | — | — | The useful life of this tool was ended after 3 minutes of cutting because the coating peeled off. | 104 |
| 5 | TiCNO | 1 | TiC | 2 | Al2O3 | 2 | — | — | The useful life of this tool was ended after 1 minute of cutting because the coating peeled off. | 95 |
| 6 | TiCN | 2 | TiC | 3 | Al2O3 | 3 | TiN | 2 | The useful life of this tool was ended after 2 minutes of cutting because the coating peeled off. | 99 |

Subsequently, each of blade members of the present invention and the conventional blade members were subjected to a wet-type continuous high-speed cutting test, and flank wear (cutting edge flank wear) was observed. The conditions of this test were as follows:

Workpiece: round bar (JIS. SNCM439; Hardness: $H_RB$ 310)

Cutting speed: 370 m/minute

Feed rate: 0.28 mm/revolution

Depth of cut: 1.5 mm

Cutting time: 20 minutes

In order to evaluate the strength of each blade member thus obtained, resistance (transverse rupture strength) was tested. The results are indicated in Table 5.

From the results shown in Table 5, each of surface coated blade meanders Nos. 25 to 32 of the present invention could secure a superior sintering degree with the action of the materials such as $ZrO_2$, stabilized $ZrO_2$, chromium, chromium carbide, and chromium nitride, in spite of the fact that the cermet substrate included a relatively small amount of the binder phase. For this reason, surfacecoated blade members Nos. 25 to 32 of the present invention exhibited an excellent strength equivalent to that of the conventional surface-coated blade members No. 4 to 6, which had a relatively large amount of the binder phase. In addition, surface-coated blade members Nos. 25 to 32 of the present invention also had a superior bonding strength between the substrates and the hard coatings by virtue of the heat resisting action of materials such as chromium, chromium carbide, chromium nitride, titanium boride and zirconium boride, and exhibited a superior wear resistance during high-speed cutting associated with high heat generation. In contrast to the surface-coated blade members of the present invention, as will be apparent from the results shown in Table 5, the conventional surface-coated blade members No. 4 to 6 exhibited separation between the substrates and the hard coating layers due to the high content of the binder phase in the cermet substrate, and became fractured.

As shown above, since the surface-coated cermet blade member of the present invention had an excellent bonding strength between the substrate and the hard coating layer, the cermet blade member according to the present invention exhibited increased wear resistance without separation between the substrate and the hard coating under severe conditions in heavy duty cutting or high-speed cutting, thereby exhibiting superior cutting performance over an extended period of time.

What is claimed is:

1. A cermet blade member comprising a cermet substrate comprising:

0.2% by weight to 3% by weight of a binder phase of at least one binder metal selected from the group consisting of cobalt and nickel;

5% by weight to 30% by weight of a first hard dispersed phase of at least one material selected from the group consisting of zirconia and a stabilized zirconia; and the remainder of a second hard dispersed phase of at least one metal carbo-nitride, the metal of said metal carbo-nitride being selected from metals in Group IVA in a periodic table.

2. A cermet blade member as recited in claim 1, wherein said metal carbo-nitride is at least one material selected from the group consisting of a titanium carbo-nitride and a zirconium carbo-nitride.

3. A cermet blade member as recited in claim 2, wherein the nitrogen and carbon of said carbo-nitride are replaced with oxygen in an amount of not more than 15 atomic percent.

4. A cermet blade member comprising a cermet substrate comprising:

0.2% by weight to 3% by weight of a binder phase of at least one binder metal selected from the group consisting of cobalt and nickel;

5% by weight to 30% by weight of a first hard dispersed phase of at least one material selected from the group consisting of zirconia and a stabilized zirconia; and the remainder of a second hard dispersed phase of at least one metal carbo-nitride the metal of said metal carbo-nitride being selected from metals in Group IVA in the Periodic Table, wherein said cermet substrate further comprises 0.1% by weight to 20% by weight of a third hard dispersed phase of at least one material selected from the group consisting of a titanium boride and a zirconium boride.

5. A cermet blade member as recited in claim 4, wherein the nitrogen and carbon of said carbo-nitride are replaced with boron in an amount of not more than 15 atomic percent.

6. A cermet blade member as recited in claim 4, wherein the nitrogen and carbon of said carbo-nitride are replaced with at least one element selected from the group consisting of oxygen and boron in an amount of not more than 15 atomic percent.

7. A cermet blade member comprising a cermet substrate comprising:

0.2% by weight to 3% by weight of a binder phase of at least one binder metal selected from the group consisting of cobalt and nickel;

5% by weight to 30% by weight of a first hard dispersed phase of at least one material selected from the group consisting of zirconia and a stabilized zirconia; and the remainder of a second hard dispersed phase of at least one metal carbo-nitride, the metal of said metal carbo-nitride being selected from metals in Group IVA in the Periodic Table, wherein said cermet substrate further comprises 0.1% by weight to 5% by weight of a third hard dispersed phase of at least one material selected from the group consisting of chromium, a chromium carbide and a chromium nitride.

8. A cermet blade member as recited in claim 7, wherein the nitrogen and carbon of said carbo-nitride are replaced with oxygen in an amount of not more than 15 atomic percent.

9. A cermet blade member comprising a cermet substrate comprising:

0.2% by weight to 3% by weight of a binder phase of at least one binder metal selected from the group consisting of cobalt and nickel;

5% by weight to 30% by weight of a first hard dispersed phase of at least one material selected from the group consisting of zirconia and a stabilized zirconia; and the remainder of a second hard dispersed phase of at least one metal carbo-nitride, the metal of said metal carbo-nitride being selected from metals in Group IVA in the Periodic Table, wherein said cermet substrate further comprises 0.1% by weight to 20% by weight of a third hard dispersed phase of at least One material selected from the group consisting of a titanium boride and zirconium boride, and 0.1% by weight to 5% by weight of a fourth hard dispersed phase of at least one material selected from the group consisting of chromium, a chromium carbide and a chromium nitride.

10. A cermet blade member as recited in claim 9, wherein the nitrogen and carbon of said carbo-nitride are replaced with oxygen in an amount of not more than 15 atomic percent.

11. A cermet blade member as recited in claim 1, wherein the content of said first hard dispersed phase is within the range of 10 to 25% by weight.

* * * * *